US005831534A

United States Patent [19]

Mooney et al.

[11] Patent Number: 5,831,534

[45] Date of Patent: Nov. 3, 1998

[54] PATIENT DETECTION SYSTEM

[76] Inventors: John M. Mooney, 2552 Crystal Springs Rd., Camino, Calif. 95709; Cherilyn E. Bolton, 2240 Forebay Rd., Pollock Pines, Calif. 95726; Curtis D. Johnson, 3929 Kings Way, Sacramento, Calif. 95821

[21] Appl. No.: 781,547

[22] Filed: Jan. 9, 1997

[51] Int. Cl.[6] ..... G08B 23/00

[52] U.S. Cl. ..... 340/573; 340/568; 340/570; 340/525.23; 340/332; 340/586.07; 250/393; 250/394; 250/206

[58] Field of Search ..... 340/573, 563, 340/569, 570, 674, 825.28, 825.29, 332, 309.4, 286.06, 286.07, 286.08; 250/393, 394, 559.01, 559.29, 559.3, 559.4, 206

[56] References Cited

U.S. PATENT DOCUMENTS

| | | | |
|---|---|---|---|
| 2,980,890 | 4/1961 | Staten | 340/825.28 |
| 3,261,011 | 7/1966 | Crosthwait | 340/311.1 |
| 3,577,124 | 5/1971 | Kabayashi | 340/825.28 |
| 3,599,199 | 8/1971 | Bunting | 340/286.07 |
| 3,599,200 | 8/1971 | Bunting | 340/286.07 |
| 3,656,113 | 4/1972 | Lince | 340/825.28 |
| 4,183,019 | 1/1980 | Lehhtman | 340/539 |
| 4,204,632 | 5/1980 | Cook | 232/34 |
| 4,814,742 | 3/1989 | Morita et al. | 340/825.54 |
| 4,859,993 | 8/1989 | Kagami et al. | 340/674 |
| 4,868,543 | 9/1989 | Binkley | 340/569 |
| 4,937,743 | 6/1990 | Rassman et al. | 705/8 |
| 4,965,551 | 10/1990 | Box | 340/545 |
| 5,059,943 | 10/1991 | LoBello | 340/309.4 |
| 5,079,539 | 1/1992 | Hatori | 340/568 |
| 5,103,204 | 4/1992 | Hartman | 340/332 |
| 5,608,207 | 3/1997 | Allen et al. | 250/214 AG |

*Primary Examiner*—Jeffery A. Hofsass
*Assistant Examiner*—Benjamin C. Lee
*Attorney, Agent, or Firm*—John P. O'Banion

[57] ABSTRACT

A patient detection system having a plurality of optical sensors associated with a corresponding plurality of file receptacles at a health care facility. The optical sensors are interfaced with one or more visual display devices. Insertion of a patient's file into a file receptacle automatically generates an output signal that activates remotely located corresponding visual indicators that notifies health care personnel that a patient is waiting.

8 Claims, 6 Drawing Sheets

PATIENT DETECTION SYSTEM

BACKGROUND OF THE INVENTION

1. Field of the Invention

This invention pertains generally to devices and methods for notifying physicians and other health care personnel of the presence of a patient waiting in an examination or other room, and more particularly to an apparatus which optically detects the insertion of a patient's file within a receptacle and generates a corresponding signal which is displayed on a light panel to alert health care personnel of a patient waiting to be seen.

2. Description of the Background Art

Health care facilities typically include multiple examination rooms wherein patients consult physicians, chiropractors, nurse practitioners, or other health care personnel. Since health care personnel are frequently in high demand, and emergency situations create additional unscheduled demands on such personnel, patients who schedule visits to health care facilities must often wait to be seen. Upon arriving at or checking into the health care facility, a patient may be asked to wait in a waiting room or lobby area, or be guided to a particular examination room wherein the patient awaits the availability of the health care professional.

A widespread problem at facilities having multiple health care professionals and multiple examination rooms is that treating personnel may be unaware of, or lose track, of the presence of waiting patients, which can result in extended waiting periods for patients and generally lead to patient dissatisfaction. Further, information regarding the availability of examination rooms is frequently needed in order to avoid delay and promote efficient use of examination rooms, requiring personnel to check or investigate the rooms for availability. Various systems have been developed which are used to monitor the presence or absence of persons in examination rooms. However, such systems typically require manual activation in some manner, such as pressing buttons or switches to activate lights on a display panel. Due to the many demands on health care personnel and the many distractions occurring in health care facilities from emergency situations and other events, these systems are prone to user error and can result in prolonged waiting by patients and non-optimum use of examination rooms. Currently, there is no device or method available which effectively addresses these problems.

Accordingly, there is a need for a waiting patient detection system which accurately and automatically monitors the presence or absence of waiting patients within examination and other waiting rooms, which does not require activation of buttons or switches, and which is not prone to error resulting from the distractions to medical personnel which occur in medical facilities. The present invention satisfies those needs, as well as others, and generally overcomes the deficiencies found in the background art.

SUMMARY OF THE INVENTION

The present invention pertains to a patient detection system which automatically alerts health care personnel to the presence of a patient within an examination room or other waiting area without requiring manual activation of switches or buttons, and provides a display indicating the presence or absence of waiting patients.

Health care facilities having multiple examination rooms and/or multiple health care providers nearly always employ a "pocket" or other receptacle into which the patient's file, information sheet or like item is placed for the health care provider to review prior to seeing the patient. This receptacle may be located in a general waiting area, on the door to an examination room, or on the wall adjacent to the door to the examination room. When the patient is ready to be seen, the patient's file or information sheet is placed within the receptacle for the attending health care professional. In general terms, the present invention comprises an optical sensing means for detecting the insertion of a patient's file or other paperwork into the file receptacle and at least one display means operatively coupled and responsive to the optical sensing means to notify health care personnel of the presence of a waiting patient. The sensitivity of the optical sensing means can be adjusted to accommodate different sized receptacles and/or file folders or other sheets placed into the receptacle.

By way of example, and not of limitation, the optical sensing means preferably comprises a photoemitter/photodetector pair which is positioned inside the file receptacle in a manner such that placing a file or other sheet item into the receptacle will alter light received by the photodetector from the photoemitter. The display means preferably comprises a plurality of lamp modules which each have a plurality of light emitting diodes (LED) or other light emitting devices corresponding to each file receptacle and photoemitter/photodetector pair. Each lamp module is operatively coupled to each photodetector. A plurality of corresponding lamp drivers are preferably interposed between the photodetectors and lamp modules.

When the file receptacle is empty, the photodetector will receive a steady state signal and produce a corresponding "null" output voltage. When the patient's file or information sheet is placed into the receptacle, the optical path between the photoemitter and photodetector will be altered and the voltage output of the photodetector will change. This change in voltage output is detected and a corresponding driving signal is then sent to each of the each of the lamp modules whereon a light emitting diode corresponding to the particular receptacle is activated to indicate the presence of the file and thus the presence of a waiting patient. The health care professional needs merely to view a nearby lamp module to be alerted to the presence of a waiting patient. No additional user input such as the actuating of switches is required.

An object of the invention is to provide a waiting patient detection system which automatically monitors the presence or absence of a waiting patient by detecting insertion of the patient's file or information sheet into a file receptacle.

Another object of the invention is to provide a waiting patient detection system which does not require users to activate switches or buttons.

Another object of the invention is to provide a waiting patient detection system which reduces the waiting time of patients.

Another object of the invention is to provide a waiting patient detection system which monitors the presence or absence of patients within multiple examination rooms.

Another object of the invention is to provide a waiting patient detection system which optimizes the efficient use of examination rooms in health care facilities.

Further objects and advantages of the invention will be brought out in the following portions of the specification, wherein the detailed description is for the purpose of fully disclosing preferred embodiments of the invention without placing limitations thereon.

BRIEF DESCRIPTION OF THE DRAWINGS

The invention will be more fully understood by reference to the following drawings which are for illustrative purposes only.

DESCRIPTION OF THE PREFERRED EMBODIMENTS

Figure 1:
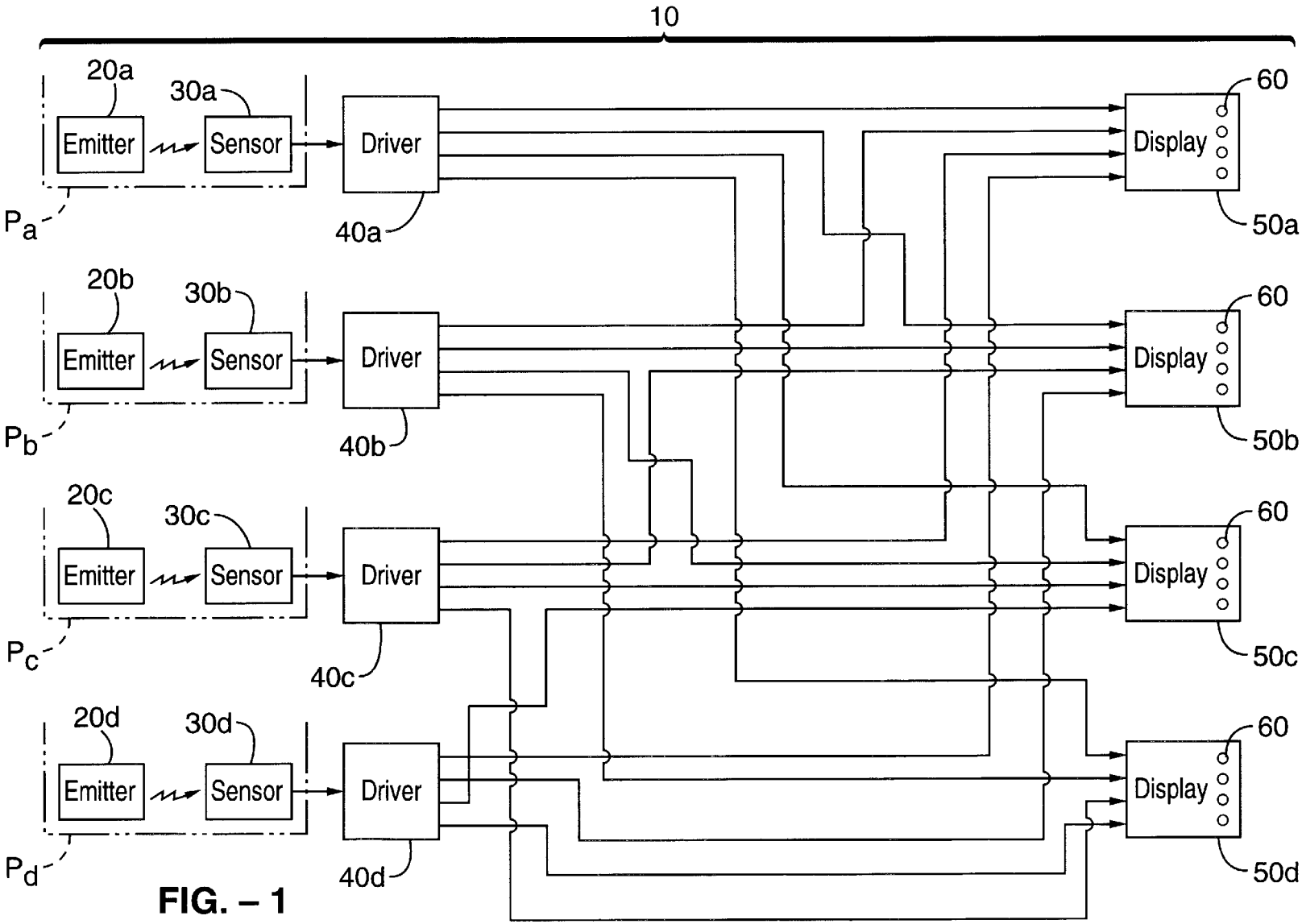
FIG. 1 is a functional block diagram of a patient detection system in accordance with the present invention.

Referring more specifically to the drawings, for illustrative purposes the present invention is embodied in the apparatus generally shown in FIG. 1 through FIG. 8, where like reference numerals denote like parts. It will be appreciated that the apparatus may vary as to configuration and as to details of the parts without departing from the basic concepts as disclosed herein. While the invention is disclosed in terms of use with a medical facility having multiple examination rooms and multiple attendant health care professionals, it should be readily apparent to those of ordinary skill in the art that the invention may be used as an indicator system generally for various applications based upon detection of the presence or absence of sheet items within receptacles.

Figure 2:
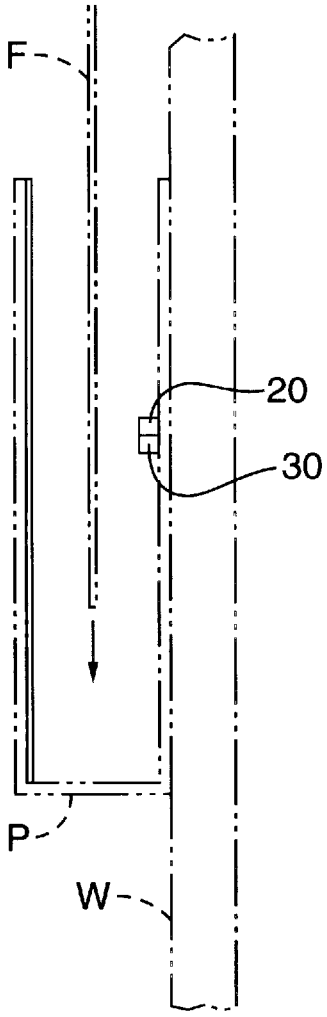
FIG. 2 is a diagrammatic view of a file folder being placed in a wall receptacle employing the sensor of the present invention.

Referring first to FIG. 1, a functional block diagram of a patient detection system 10 in accordance with the present invention is generally shown configured for use in connection with a plurality of receptacles P. As can be seen in FIG. 2, one or more receptacles P are generally mounted on a wall W, and may be located together in a common area such as a waiting or reception room or associated with individual examination rooms by mounting on the door or wall thereof. Receptacles P are generally structured and configured to receive and hold a standard file F, an information sheet, or a like sheet item. When the patient is ready to consult a health care professional or be admitted to an examination room, the patient's file F is inserted into the receptacle P.

Figure 4:
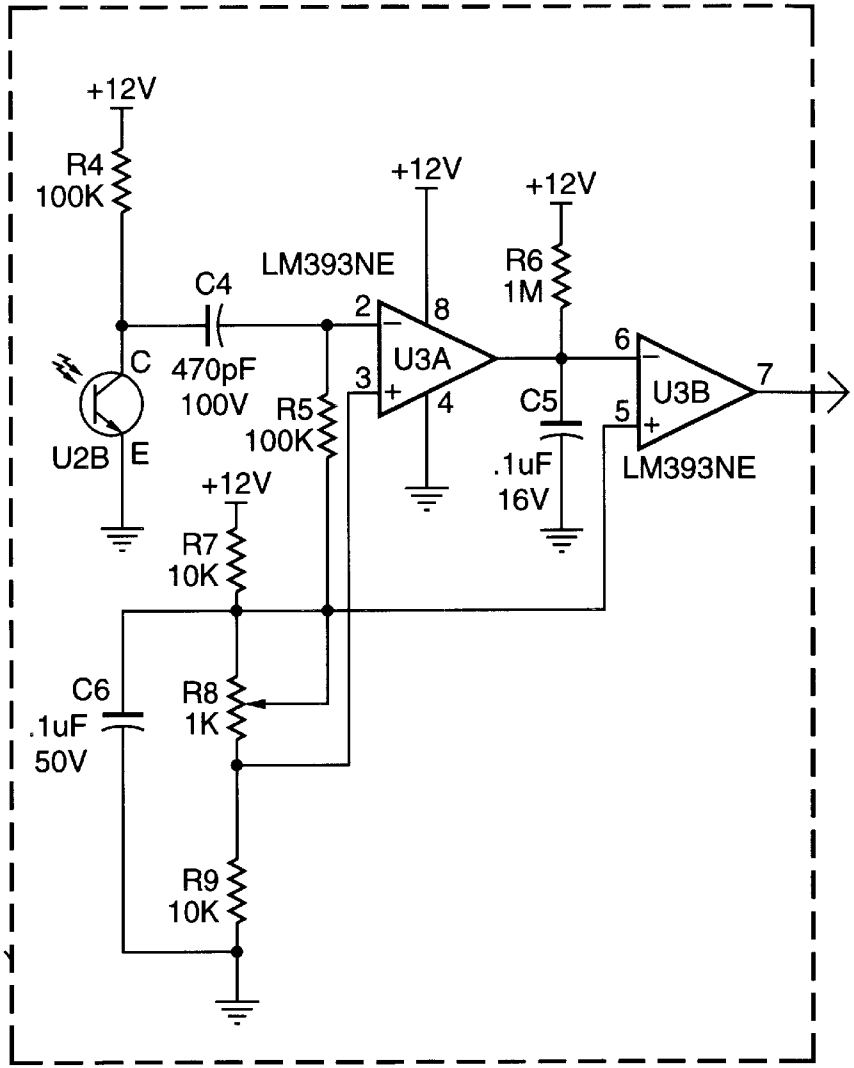
FIG. 4 is a schematic diagram of a sensor of the patient detection of the patient detection system shown in FIG. 1.
Figure 3:
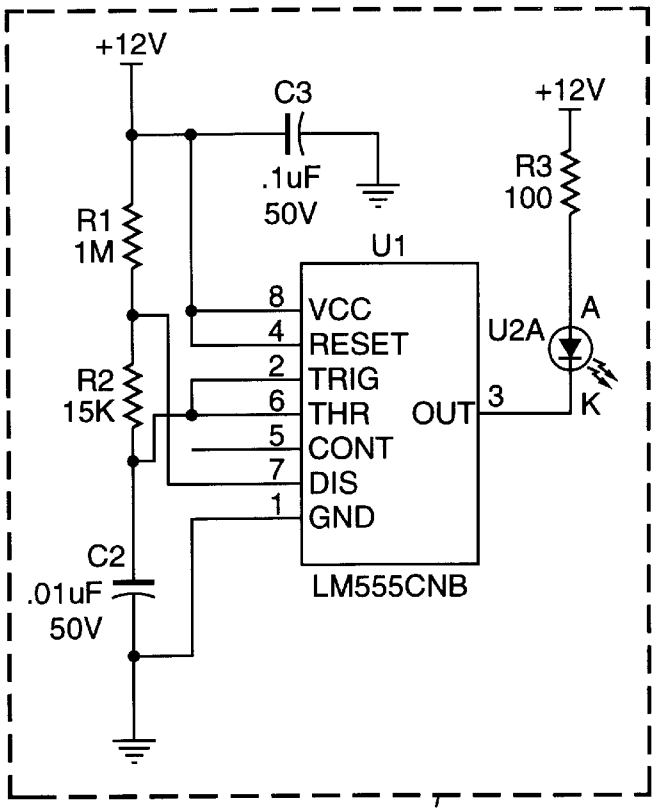
FIG. 3 is a schematic diagram of an emitter of the patient detection of the patient detection system shown in FIG. 1.

In order to detect the insertion of a file F or the like into a receptacle P, a patient detection system 10 includes one or more optical sensing means such as emitters 20*a*, 20*b*, 20*c*, 20*d* and one or more corresponding sensors 30*a*, 30*b*, 30*c*, 30*d* corresponding to one or more receptacles Pa, Pb, Pc, Pd shown in FIG. 1. Referring also to FIG. 3 and FIG. 4, each emitter/sensor pair preferably comprises a single, commercially available optical sensor device such as an Omron EE-SB5 or a Kodenshi SG107, which includes a GaAs, GaAsP or like photodiode which outputs light at a near-infrared wavelength of approximately 980 nanometers, and a phototransistor detector which detects the near infrared light from the LED and produces an output according to the detected light. The output of the photodetectors, which is a current output, is converted to a voltage signal by resistor R4 shown in FIG. 4.

Referring to FIG. 3, emitters 20 preferably include a timing circuit such as an LM555 to pulse the photoemitter output. Pulsing the output of the photoemitters provides a significant advantage in that it overcomes interference from ambient light. By pulsing the emitters, the received pulses can be separated from the steady-state background room lighting. This is accomplished by capacitor C4 (FIG. 4) which blocks the DC response to the room light and passes only the received pulses to the comparator. Pulsing the emitters also has the effect of reducing power requirements.

As can be seen in FIG. 2, in the preferred embodiment emitters 20 and sensors 30 are positioned side-by-side on the same inside wall of receptacle P. Preferably, the opposing inside wall of receptacle P should not be reflective or should exhibit a lesser degree of reflectivity that the file F being inserted into receptacle P. In this way, when a file F is inserted into receptacle P, it will reflect light back from the emitter to the adjacent phototransistor Therefore, the effect is to sense the difference in reflectivity between the surface of a file F and the inside surface of receptacle P when file F is inserted into receptacle P is detected. The preferred Omron and Kodenshi photoemitter/photodetector devices described above are generally sensitive enough to detect reflectivity differences between the surfaces of receptacles P and conventional paper sheet items such as files F without the need for using highly reflective surfaces. If necessary, however, the sensitivity can be adjusted by resistor R8 (FIG. 4) to accommodate the different reflective characteristics of file folders. Also, as an alternative, separate photoemitters and photodetectors can be placed on opposing inside walls of the receptacle P, such that insertion of a file F into the receptacle will block light transmission and the absence of light transmission detected instead of detecting a change in the amount of reflected light.

Figure 5:
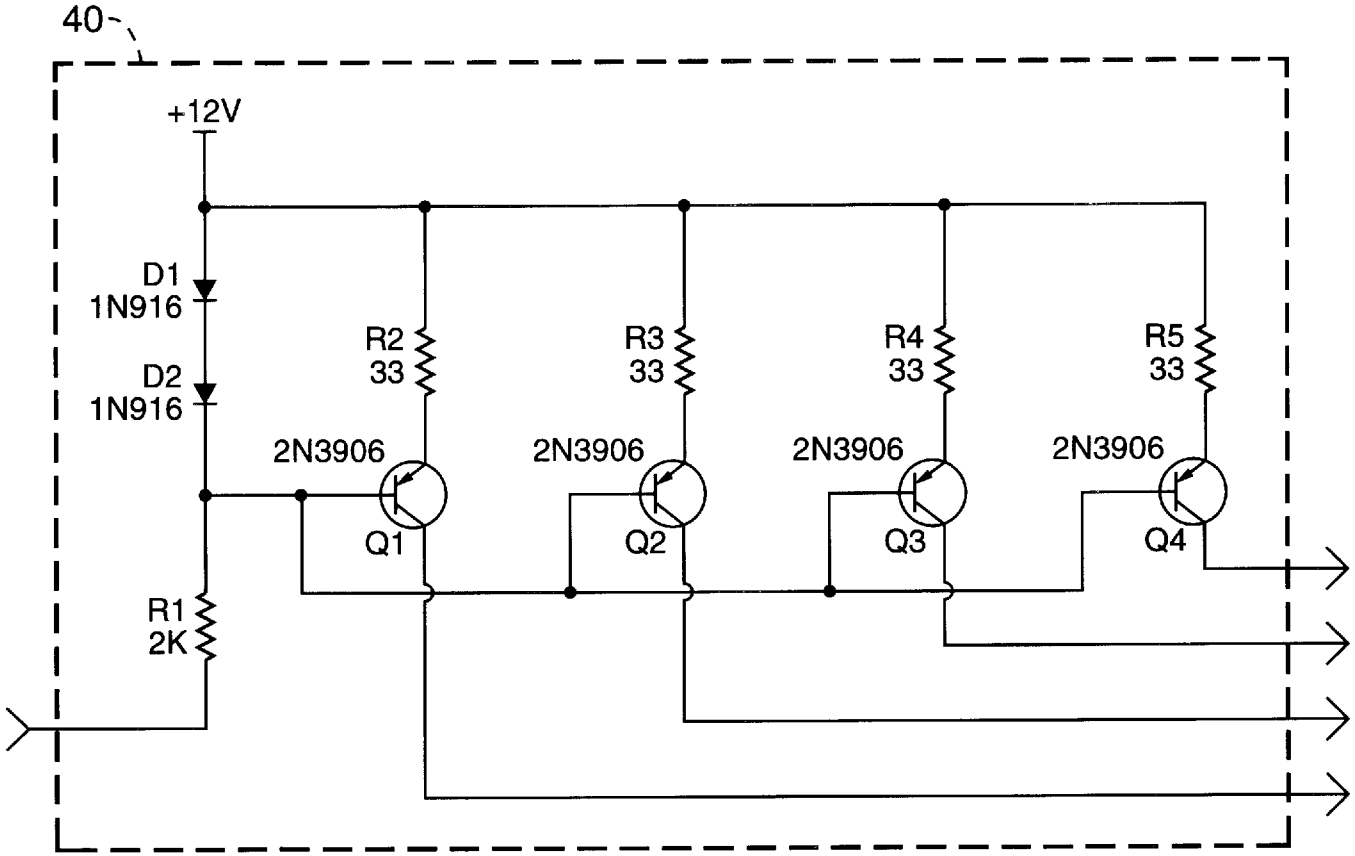
FIG. 5 is a schematic diagram of a display driver of the patient detection of the patient detection system shown in FIG. 1.

It will be appreciated that, in the preferred embodiment where differences in the amount of reflected light are to be detected, it is necessary to detect a change from a steady state condition. In other words, when a receptacle P is empty, the amount of reflected light will remain constant, as will the voltage output from the photodetector. By using this steady state output as a reference voltage, changes in reflectivity can be sensed by sensing changes in the output voltage. Accordingly, sensors 30 include a comparator circuit as shown in FIG. 4 comprising LM393NE's or like devices. By adjusting R8, the output of a sensor 30 can be nulled in the steady state condition, so that sensor 30 does not produce a driving voltage until there is a change the amount of reflected light. Additionally, R8 provides a sensitivity adjustment such that, instead of sensor 30 producing a zero output voltage in the steady state condition, an output voltage could be set based on the trigger point of the corresponding transistor switch in lamp driver 40 (FIG. 5). This will also allow compensation for varying surface reflectivity's of receptacles P.

Referring more particularly to FIG. 3 and FIG. 4, the output of the phototransistor U2B will be a series of pulses in response to the pulsed light emitted from emitter U2A. The DC level at the collector of the phototransistor depends on the response of the phototransistor to ambient room light.

The more light that is received, the lower the voltage level. On the other hand, the pulsed output of the phototransistor is responsive to the pulses from the emitters. The more light that is received from the emitter, the larger the pulses. The output signal from the phototransistor is applied to capacitor C4, which blocks the DC and only passes the pulses. The output side of C4 is biased at approximately 6.3 volts through R5 and voltage divider R7 through R9. The waveform of the resultant signal is essentially the same as the pulse signal at the collector of the phototransistor, except that we now know the DC level. The signal is than applied to the comparator U3A. The other input to the comparator also comes from the resistor divider R7 through R9 but at a lower levels. The voltage difference between the two levels can be adjusted by R8 and is set so that reflected pulses that are smaller than the difference are ignored, but pulses that are larger than the difference trigger U3A. The circuit elements R6, C5 and U3B filter the pulsed output from U3A to produce a constant output.

The invention also includes means for taking the output signals from sensors 30 and driving light emitting diodes or other visual indicators, preferably in the form of a plurality of lamp drivers 40*a*, 40*b*, 40*c*, 40*d*, each of which are operatively connected to a corresponding sensor 30*a*, 30*b*, 30*c*, 30*d*. A schematic diagram of an exemplary lamp driver 40 is shown in FIG. 5.

Figure 6:
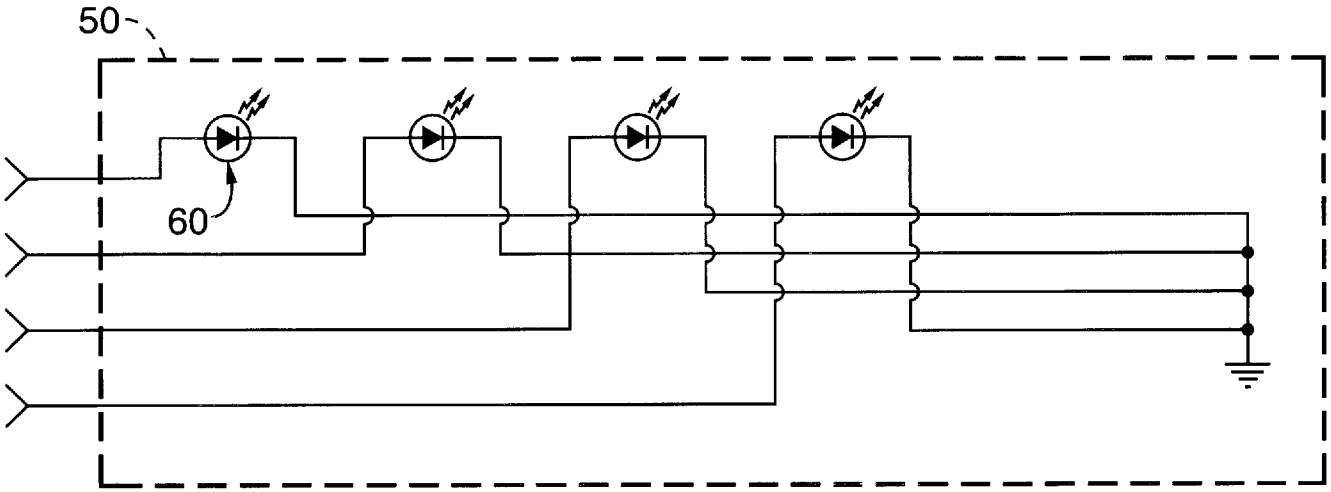
FIG. 6 is a schematic diagram of a display module of the patient detection of the patient detection system shown in FIG. 1.

Display means for indicating or signaling the detection of medical files F or other sheet items within receptacles P are included with the invention, with the display means preferably comprising a plurality of display or lamp modules 50*a*, 50*b*, 50*c*, 50*d*, with each lamp module 50*a–d* operatively connected to each lamp driver 40*a–d* and photodetector 30a–d, as shown in FIG. 1. Each lamp module 50*a–d* includes a plurality of lamps or LEDs 60, with one LED 60 corresponding to each receptacle P and photoemitter/photodetector pair 20*a–d*/30*a–d*. The display means may alternatively comprise one or more liquid crystal displays which are suitably configured to display or indicate signal output from photodetectors 30*a–d*. An exemplary schematic diagram of a lamp module 50 is shown in FIG. 6.

Figure 7:
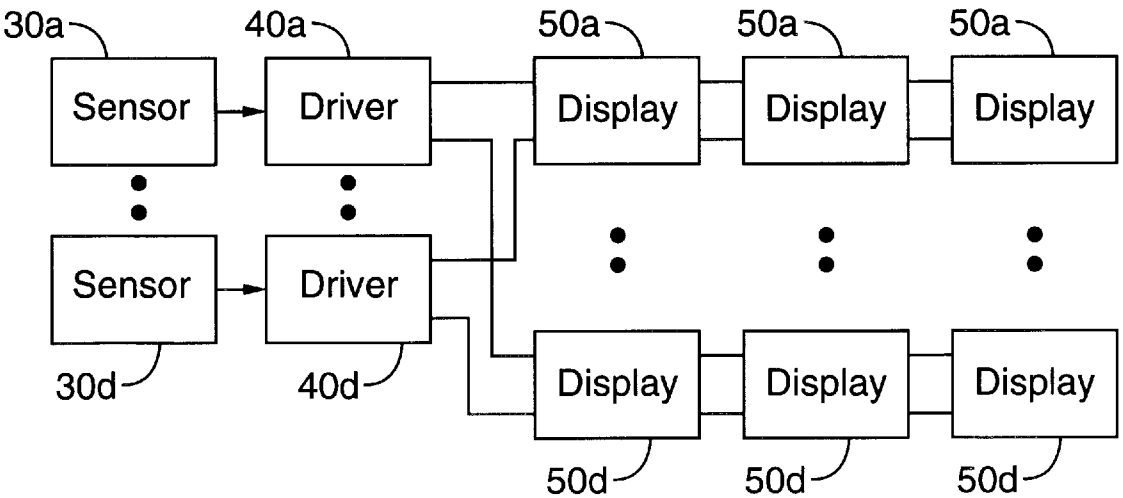
FIG. 7 is a functional block diagram of an alternative embodiment of the patient detection system shown in FIG. 1 where multiple display modules are connected in series.

Referring again to FIG. 1, note that individual output lines from a lamp driver 40 can be connected to the same LED position in different lamp modules 50 for quick visual identification of which receptacle P contains a file folder F. It can also be seen that the outputs from different lamp drivers are connected to different LED's of the same display. Referring also to FIG. 7, however, it can be seen that a plurality of lamp modules 50 can also be electrically connected in series so that a single output line from a lamp driver 40 drives the same LED in multiple displays. Each output from a lamp driver 40 is capable of driving up to five LED's in different displays.

While patient detection system 10 as shown as being structured and configured to monitor four receptacles and to correspondingly display the status on lamp modules, it should be readily apparent to those skilled in the art that the number of receptacles and lamp modules can be varied as required. For example, where four receptacles are used but there are more than four locations in which lamp modules are to be placed, additional lamp modules can be added in parallel. If more than four receptacles are used, corresponding lamp drivers would be added and the number of light emitted diodes in the lamp modules would be correspondingly increased.

Figure 8:
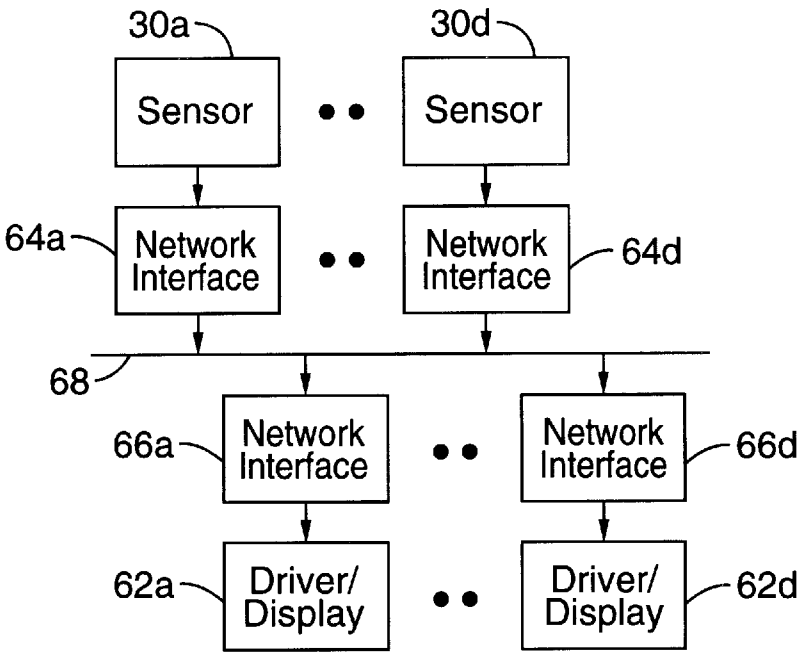
FIG. 8 is a functional block diagram of an alternative embodiment of the patient detection system shown in FIG. 1 where a communications network is employed for signal distribution.

It will be appreciated that the wiring required to make up the electrical connections where multiple emitter/sensor pairs, display drivers, and lamp modules are employed can be extensive. Accordingly, it may be desirable to simplify the electrical connections. Referring to FIG. 8, an example of a simpler interface is shown in the form of a multidrop network. Here, the system uses the same emitter/sensor pairs as before, but the lamp drivers and lamp modules constructed as an integrated unit. The emitter/sensor pairs and lamp driver/lamp module assemblies 62 are connected across a network using conventional network interfaces 64, 66 respectively. A single cable 68 of two twisted pairs can be run throughout a building for making the connections. One of the two twisted pairs would carry the network information (e.g., using EIA RS485 network signal standards) and the other pair would carry power from a central power supply (not shown). The network interfaces would manage traffic on the network and have switches to configure the sensor and display addresses which associate the display LED's with the sensor numbers to that the correct LED's are activated when the sensor is triggered. Those skilled in the art will appreciate that such a network configuration and its interfaces are conventional and, therefore, their details are not described herein.

It will also be appreciated that the lamp modules can be mounted in examination rooms, waiting areas, file rooms, break rooms, and other areas where they can be easily seen so that a waiting patient will not be overlooked. The receptacles may also be configured in may versatile ways. For example, suppose that a health care facility has several health care providers and that patients are met in a common waiting area before being taken back to an examination or treatment room. The waiting area could include one receptacle for each health care provider and, by viewing a lamp module, a particular heath care provider would know that his or her patient is waiting to be seen. Or, if patients are taken to a private examination room while they are waiting to be seen, the receptacles could be located on the door of the examination room or adjacent thereto. Again, in a multiple health care provider facility, each health care provider could have his or her own examination room and know that their patient is waiting. Those skilled in the art will appreciate that many other configurations are possible with the present invention. Significantly, the presence or absence of waiting patients within a plurality of examination rooms or a common waiting area can be quickly and easily determined without requiring physical investigation of the rooms or waiting area.

Therefore, it can be seen that when a patient is ready to be seen by a particular health care professional, the patient's file F is inserted into the corresponding receptacle or pocket P in a conventional manner. As the medical file F is received by the receptacle P, light from emitter 20 is blocked or interrupted by the file and the change is detected by sensor 30. A corresponding voltage signal is generated by sensor 30, and lamp driver 40 in turn activates the corresponding light emitting diode 60 other visual display device in lamp module 50. The present invention thus provides for automatic and accurate monitoring and detection of a patient waiting for treatment, and displays signals indicating that the patient is ready. No input or effort is required other than the insertion of medical files into receptacles P as is routinely carried out, and thus the possibility of errors and confusion due to failure to activate switches, or activation of incorrect switches, is eliminated.

Although the description above contains many specificities, these should not be construed as limiting the scope of the invention but as merely providing illustrations of some of the presently preferred embodiments of this invention. It will also appreciated that analog and digital equivalents of circuit elements could be substituted where appropriate, and that alternative circuit configurations could be employed. Thus the scope of this invention should be determined by the appended claims and their legal equivalents.

What is claimed is:

1. A patient detection system, comprising:

(a) optical sensing means for sensing insertion of a sheet item associated with patient information into a receptacle, said optical sensing means including a photoemitter and a photodetector, said photodetector producing an output voltage responsive to light from said photoemitter being reflected within said receptacle;

(b) visual display means for visually indicating detection of said sheet item in said receptacle to notify detection of a patient presence;

(c) comparator means for comparing said output voltage from said photodetector to a reference voltage and producing a driving voltage for said visual display means;

(d) means for adjusting said reference voltage to set said driving voltage from said comparator means to a steady state level wherein said visual display means is activated upon insertion of a sheet item in said receptacle;

(e) means for generating pulsed light emissions from said photoemitter; and (f) means for filtering said pulsed light emissions from ambient light.

2. A patient detection system as recited in claim 1, further comprising display driver means for amplifying signals from said optical sensing means, said display driver means operatively connected to said optical sensing means, said visual display means operatively coupled to said display driver means.

3. A patient detection system as recited in claim 1, further comprising means for adjusting sensitivity of said optical sensing means.

4. A patient detection system as recited in claim 1, wherein said visual display means comprises a lamp module.

5. A patient detection system, comprising:

(a) optical sensing means for detecting the presence of a reflective member associated with patient information into a receptacle, said optical sensing means including a photoemitter and a photodetector, said photodetector producing an output voltage responsive to light from said photoemitter being reflected within said receptacle;

(b) display means for visually indicating detection of said reflective member in said receptacle to notify detection of a patient presence;

(c) display driver means for amplifying signals from said optical sensing means, said display driver means operatively connected to said optical sensing means, said display means operatively coupled to said display driver means;

(d) comparator means for comparing said output voltage from said photodetector to a reference voltage and producing a driving voltage for said display driver means;

(e) means for adjusting said reference voltage to set said driving voltage from said comparator means to a steady state level wherein said display driver means is activated upon insertion of a reflective member in said receptacle;

(f) means for generating pulsed light emissions from said photoemitter; and (g) means for filtering said pulsed light emissions from ambient light.

6. A patient detection system as recited in claim 5, further comprising means for adjusting sensitivity of said optical sensing means.

7. A patient detection system, comprising:

(a) a plurality of receptacles;

(b) a plurality of photoemitter/photodetector pairs, each said photoemitter/photodetector pair associated with a corresponding one of said receptacles;

(c) a plurality of lamp drivers, each said lamp drivers operatively connected to a corresponding one of said photoemitter/photodetector pairs;

(d) a plurality of lamp modules, each said lamp modules operatively connected to a lamp driver;

(e) wherein each said photodetectors produces an output voltage responsive to light from a corresponding photoemitter being reflected from a corresponding sheet item associated with patient information being inserted within a corresponding receptacle;

(f) comparator means for comparing said output voltage from each said photodetectors to a reference voltage and producing a driving voltage for a corresponding lamp driver;

(g) means for adjusting said reference voltage to set said driving voltage from said comparator means to a steady state level wherein each said lamp drivers is activated upon insertion of a sheet item in a corresponding receptacle;

(h) means for generating pulsed light emissions from said photoemitter; and (i) means for filtering said pulsed light emissions from ambient light.

8. A patient detection system as recited in claim 7, wherein each said lamp module includes a plurality of light emitters, each said light emitter corresponding to one of said receptacles and associated photoemitter/photodetector pair.

* * * * *